US005778708A

United States Patent [19]

Crosby et al.

[11] Patent Number: 5,778,708

[45] Date of Patent: Jul. 14, 1998

[54] DOOR LOCKING MECHANISM FOR SAFES

[75] Inventors: Gauis P. Crosby, Springville; Terry R. Zierenberg, Mapleton, both of Utah

[73] Assignee: Liberty Safe & Security Products, Inc., Springville, Utah

[21] Appl. No.: 803,410

[22] Filed: Feb. 20, 1997

Related U.S. Application Data

[63] Continuation of Ser. No. 435,583, May 5, 1995, abandoned.

[51] Int. Cl.[6] ..... E05B 63/14

[52] U.S. Cl. ..... 70/118; 70/120; 70/461; 109/59 R; 109/59 T; 292/36; 292/158; 292/159; 292/DIG. 60

[58] Field of Search ..... 70/461, 103, 108, 70/113, 118–120; 109/59 R, 59 T; 292/36, 156, 159, DIG. 60, 35, 157, 158, 160, 161

[56] References Cited

U.S. PATENT DOCUMENTS

| | | | |
|---|---|---|---|
| 393,883 | 12/1888 | Brown, Jr. | 292/36 X |
| 526,456 | 9/1894 | Murdie | 70/108 |
| 966,195 | 8/1910 | Golden | 292/36 |
| 1,134,175 | 4/1915 | Wheary | 292/35 |
| 1,643,538 | 9/1927 | Bell | 292/36 X |
| 2,468,251 | 4/1949 | Wiederman | 292/36 X |
| 2,537,736 | 1/1951 | Carlson | 292/156 X |
| 3,464,472 | 9/1969 | Reynolds | 411/361 X |
| 4,223,943 | 9/1980 | VanHulle et al. | 292/DIG. 60 X |
| 4,288,944 | 9/1981 | Donovan | 49/395 |
| 4,368,905 | 1/1983 | Hirschbein | 292/5 |
| 4,458,940 | 7/1984 | Hildebrand | 292/167 X |
| 4,520,736 | 6/1985 | Crosby et al. | 109/60 |
| 4,679,415 | 7/1987 | Spratt | 70/118 |
| 4,704,970 | 11/1987 | Sanderson et al. | 109/73 |
| 4,714,030 | 12/1987 | Cole | 109/61 |

FOREIGN PATENT DOCUMENTS

| | | | |
|---|---|---|---|
| 636744 | 4/1928 | France | 70/120 |
| 803694 | 10/1936 | France | 292/36 |
| 219286 | 2/1910 | Germany | 109/59 |
| 283783 | 4/1915 | Germany | 70/120 |
| 339166 | 7/1921 | Germany | 109/59 |
| 401660 | 9/1924 | Germany | 292/159 |
| 587940 | 11/1933 | Germany | 70/1.5 |
| 435341 | 5/1948 | Italy | 292/34 |
| 9655 | 4/1898 | United Kingdom | 109/59 |

*Primary Examiner*—Lloyd A. Gall
*Attorney, Agent, or Firm*—Thorpe, North & Western, LLP

[57] ABSTRACT

A door locking mechanism is disclosed including a door locking member in communication with a lock-actuated bolt which selectively allows rotation of a rotatable actuator plate member. The rotating actuator plate member is attached to a rotatable handle and to a plurality of actuator bars which move locking bolts so as to selectively prevent opening of the door. The rotatable actuator plate member enables all of the actuators to be moved from a single location so that a plurality of cams, etc., are not needed to move locking bolts positioned about the perimeter of the door between open and locking positions. In an additional aspect of the invention, horizontally extending actuator bars are adjustably attached to elongate locking bars having a plurality of locking bolts attached thereto, so as to enable assembly of the locking structures of the door locking mechanism without assembly, and to enable interchangeability of parts.

27 Claims, 5 Drawing Sheets

DOOR LOCKING MECHANISM FOR SAFES

This application is a continuation of application Ser. No. 08/435,583, filed May 5, 1995 now abandoned.

BACKGROUND OF THE INVENTION

The present invention relates to a door locking mechanism, and in particular to a mechanism for activating a plurality of locking bolts in high security devices such as safes.

When securing a safe or other security enclosure, it is important to ensure that each possible method for opening the safe is guarded against unauthorized entry. In attempts to accomplish this, numerous different methods have been developed for ensuring that the door of the safe may not be easily opened, as the door is often the most vulnerable portion of the safe. If a burglar, etc., is able to pry the door of the safe open, the structural integrity of the remainder of the safe becomes irrelevant. In attempts to overcome this concern, numerous arrangements have been made which cause a plurality of locking bolts to extend from either side of the door and into the remainder of the safe so as to prevent the door from being opened by prying or other force.

While the use of locking bolts improves the security of the door, the present arrangements for engaging the locking bolts provide insufficient protection, are difficult to use, or are overly expensive. Other systems provide adequate protection, but are needlessly complex and have numerous moving parts. If the parts fail, the owner of the safe may be unable to retrieve his or her belongings without unnecessary delay, and the possibility of destroying the safe.

Thus, there is needed a simple, efficient and cost effective method to engage locking bolts on a safe door. Such a method would minimize the number of moving parts while providing secure protection against the door of the safe being opened without authorization.

OBJECTS AND SUMMARY OF THE INVENTION

It is an object of the invention to provide a door locking mechanism for safes and the like which is inexpensive and simple to use.

It is another object of the present invention to provide a door locking mechanism for safes and the like which securely holds the safe door so as to prevent unauthorized entry.

It is another object of the present invention to provide a door locking mechanism with a minimum number of moving parts so as to decrease the risk of failure of the door locking mechanism.

It is yet another object of the present invention to provide a door locking mechanism in which the moving parts of the mechanism can be installed on a door without welding, and in which the parts are interchangeable.

The above and other objects of the invention are realized in specific illustrated embodiments of a door locking mechanism for safes and the like including a door lock in communication with a lock-actuated bolt which selectively allows rotation of an actuator plate member. The rotating actuator plate member is rotated by a handle, and when rotated, moves a plurality of actuator bars. Movement of the actuator bars moves a plurality of locking bolts disposed along a perimeter of the safe door so as to prevent the door from being pried open.

In accordance with one aspect of the invention, at least one of the actuator bars connected to the rotatable actuator plate member extends to an upper and lower end of the door and also serves as a locking bolt to engage a frame of the safe and provide resistance to opening along a central portion of the door.

In accordance with another aspect of the invention, the locking bolts are removably and adjustably connected to the actuator bars to facilitate attachment of the locking mechanism to the door without welding, provide the ability to adjust the locking mechanism once it is attached to the door, and to make respective parts interchangeable.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
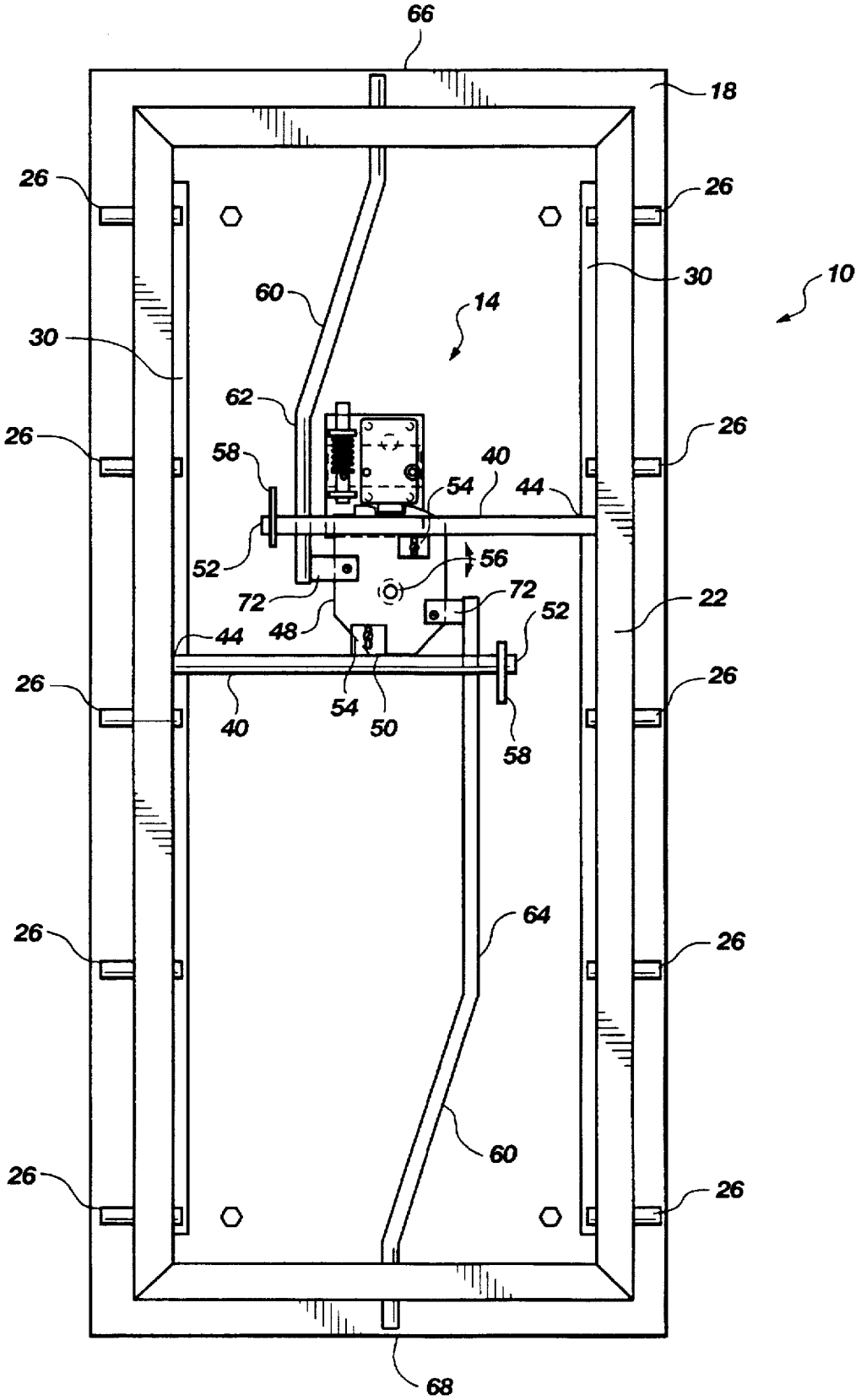
FIG. 1 shows a rear view of a safe door having a door locking mechanism made in accordance with the principles of the present invention mounted on the door.
Figure 1A:
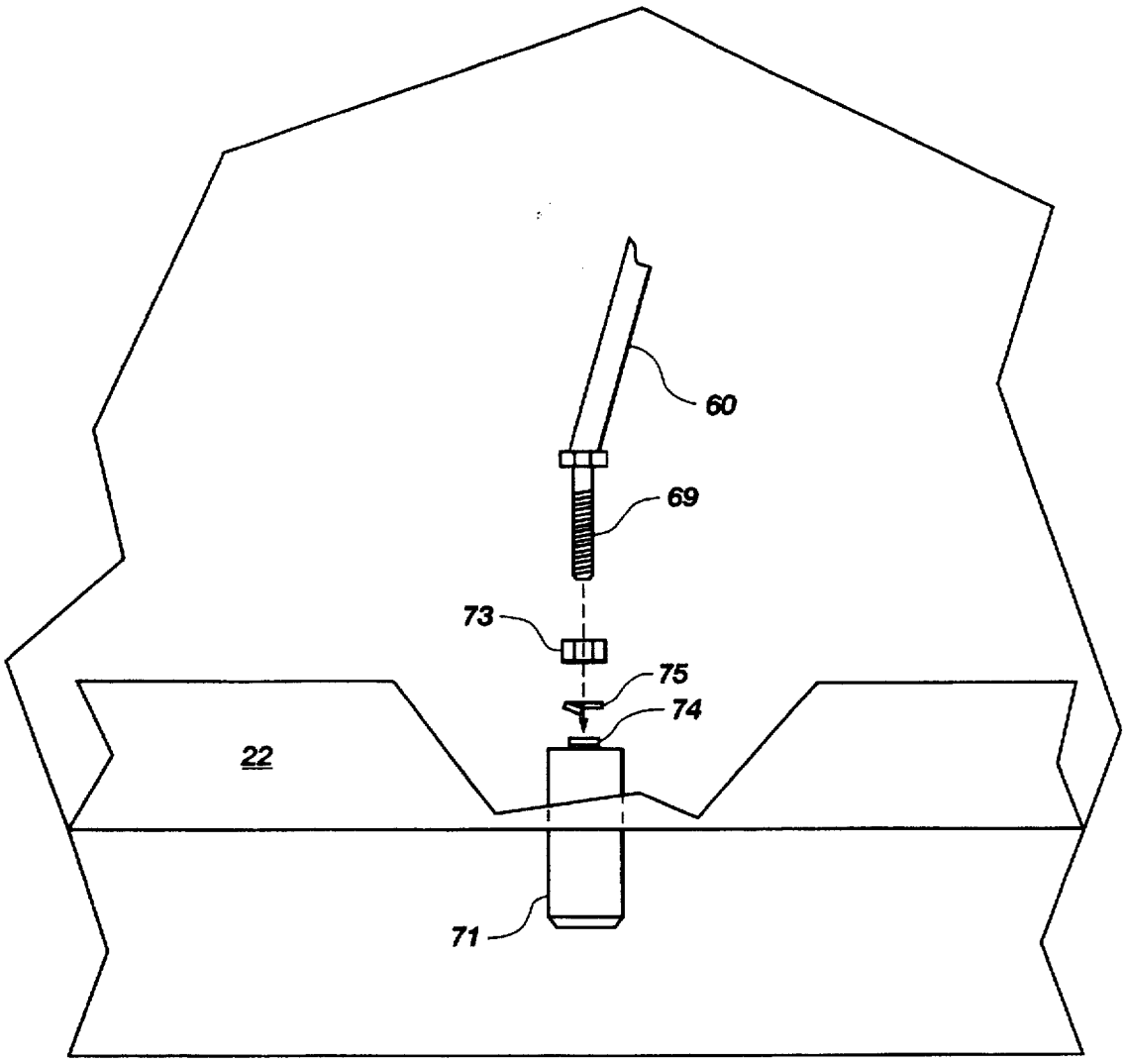
FIG. 1A shows a close-up, fragmented view of a preferred embodiment of the locking pins of the present invention.
Figure 2:
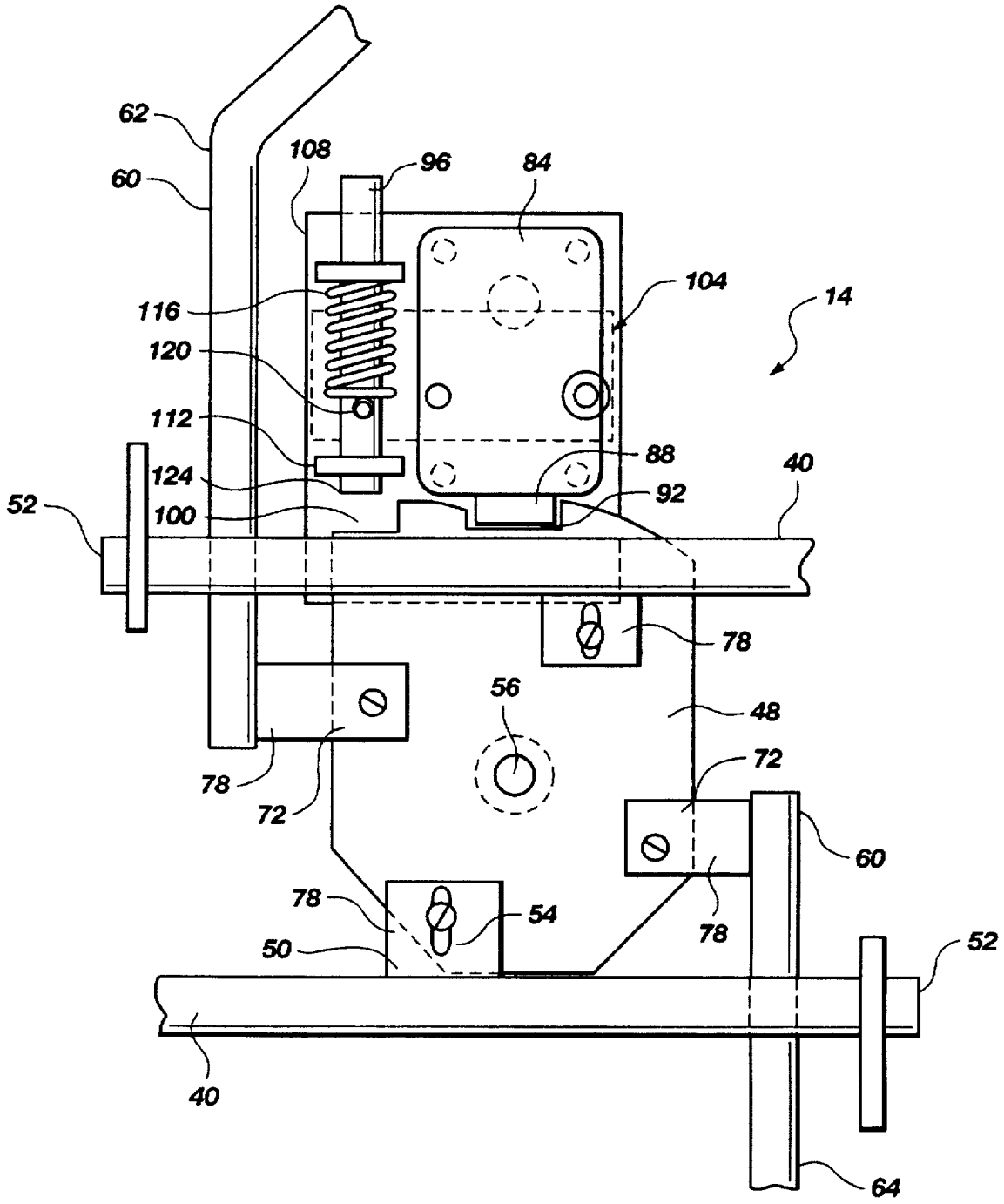
FIG. 2 shows a close-up, fragmented view of the door locking mechanism of the present invention.

Reference will now be made to the drawings in which the various elements of the present invention will be given numeral designations and in which the invention will be discussed so as to enable one skilled in the art to make and use the invention. Referring to FIGS. 1, 1A and 2, FIG. 1 shows a rear view of a safe door, generally indicated at 10, having a locking mechanism, generally indicated at 14 disposed thereon. FIG. 2 shows a close-up view of the locking mechanism 14. The safe door 10 has a generally flat face 18 and a frame 22 extending rearwardly from the face such that the frame extends into the area defined by the safe when the door 10 is closed.

Typically, the door face 18 will be steel between 0.25 and 0.75 inches thick. Obviously, thicker door faces 18 are used to provide additional security for the contents of the safe. The door frame 22 will typically be an angle frame having dimensions about 0.375 inches by 1.5 inches by 2.5 inches.

Extending through the lateral sides of the door frame 22 are a plurality of locking bolts 26. The locking bolts 26 are typically short pieces of cylindrical steel, although other shapes may be used, and will have a diameter of about 0.5 to 1.25 inches depending on the desired security level of the safe. The locking bolts 26 along each lateral side of the frame 22 are attached to a locking bar 30. Moving the locking bars 30 from a first position away from the frame 22 to a second position adjacent the frame 22, causes a change in the distance which the locking bolts 26 extend beyond the frame. When the locking bars 30 are moved away from the frame 22, the locking bolts 26 are pulled toward a center of the door, and only a small portion of the locking bolt extends beyond the frame. In such a position, the locking bolts 26 will not engage a lip of the frame body (discussed with respect to FIG. 3).

The locking bars 30 are moved between the first and second positions by a pair of elongate actuator bars 40 which extend inwardly and generally horizontally. Each of the actuator bars is attached to a locking bar 30 at a distal end 44 and to a rotatable actuator plate 48 at a midsection 50 between the distal end and a proximal end 52. The attachment between the distal end 44 of the actuator bar 40 and the locking bar 30 will typically be an adjustable attachment such as the nut and bolt attachment shown in FIGS. 4A and 4B. At the midsection 50 the actuator bars 40 are attached to the rotatable actuator plate 48 by pivotal or rotatable attachment tabs 54. The rotatable attachment tabs 54 enable the actuator bars 40 to be moved horizontally by the actuator plate 48 as the actuator plate rotates. Guides 58 help to maintain the horizontal orientation of the bars 40. When the actuator plate 48 rotates in a clockwise direction, the locking bars 30 are moved from the first, open position to a second, locking position in which the locking bolts 26 are extended to a maximum extension through the frame 22. When the safe door 10 is closed and the locking bolts 26 are in this extended position, the door 10 cannot be opened without first moving the locking bolts.

The rotatable actuator plate 48 is attached to a handle mechanism (discussed with respect to FIG. 3) by a shaft 56. Rotation of the shaft 56 causes rotation of the actuator plate 48 in the same direction.

The rotatable actuator plate 48 is also connected to two elongate locking pins 60, one of which 62 extends from the rotatable actuator plate to a top side 66 of the door, and the other of which 64 extends to a bottom side 68 of the door. The locking pins 60 may serve the functions of both the actuator bar and the locking bolts. The pins 60 are pivotally attached to the rotatable actuator plate 48 by attachment mechanisms 72. The pins 60 (or a bolt attached thereto) extend to the frame in a similar manner as the actuator bars 40 and through the frame 22 in the same manner as the locking bolts. Thus, the pins may be both actuator bars and locking bolts. The actuator pins 60 provide support in the top and bottom of door 10 along the vertical center line so that the door cannot be buckled outwardly sufficient to overcome the locking effect of the locking bolts 26.

In a preferred embodiment, the locking pins have bolts disposed on an end thereof. Each of the locking pins 60 has an ending with male threads 69 which mates with female threads in a threaded locking bolt 71 as shown in FIG. 1A. An adjustment/locking nut 73 and washer 75 are also provided to allow locking the bolt 71 in various vertical/height positions as needed, e.g., to maintain the locking bolt generally flush with the surface of the frame 22 when retracted. Alternatively, shoulder 74 on the bolt 71 could be crimped by a crimping tool, after the locking pin 60 was screwed into the bolt 71.

While each of the actuator bars 40 and the locking pins 60 could be attached directly to the rotatable actuator plate 48, it is preferred that they be attached by small tabs 54 and 72, respectively, extending from the actuator bars 40 and locking pins 60 respectively. The tabs may also be slotted, as shown with the rotatable attachment tabs 54 of actuator bars 40 in FIG. 2, to facilitate smooth rotation. The slots help to maintain the actuator bars at the same vertical position as the actuator bars move back and forth.

Positioned above the rotatable actuator plate 48 is a locking member 84 which enables or disenables rotation of the actuator plate. A retractable lock-actuated bolt 88 extends downwardly from the locking member 84 so as to nest in a channel 92 formed in the rotatable actuator plate 48 when the locking member is turned to lock. When the locking member 84 is unlocked, the lock-actuated bolt 88 is lifted from the channel 92 so that the rotatable actuator plate 48 can be turned. Those skilled in the art will recognize numerous locking arrangements which could be used in the locking member 84 while still keeping within the scope and spirit of the invention.

Also illustrated in FIGS. 1 and 2 is a dual lock system to prevent the safe from being unlocked by a force which displaces the locking member 84 from the door face 18. One common method used to force open a safe is to cut an opening in the door face 18 at the location of the locking member 84. A tool is then pushed into the hole and hammered against the locking member 84 until the locking member is dislodged from the door face 18. With many safes, once the locking member 84 is moved, the safe may be freely opened by simply rotating the handle.

In the dual lock system shown in FIGS. 1 and 2, a safety locking bolt 96 is positioned above a notch 100 formed in the rotatable actuator plate 48. The safety locking bolt 96 is held in a raised (nonlocking) position by spring pin 120 which nests at least partially in the bolt. The spring pin 120 is held in a cocked position by plate 104 (shown by a dotted line in FIG. 2).

The safety bolt 96 is oriented in a generally vertical position by guides 108 and 112 which will typically be attached to the door face 18. The bolt 96 passes through openings in the guides 108 and 112.

A spring 116 is attached to the bolt 96 at one end and butts against the upper guide 108 at the other end. The spring 110 is held in a compressed state by a spring pin 120 which is removably attached to a midsection of the bolt 96. The lower guide 112 is positioned low enough that it will not interfere with extension of the spring 116 and the bolt 96 contacting the notch 100 in the rotating actuator plate.

When unauthorized entry to the safe is attempted in the manner described above, the force applied to the locking member 84 to dislodge it from the door 18 will cause the plate 104 to be dislodged, thereby dislodging the spring pin 120 from the safety locking bolt 96. Once the spring pin 120 is released, the bolt 96 is able to move. Thus, the spring 116 will act on the bolt 96 and force a lower end 124 of the bolt 96 down into the notch 100 in the rotatable actuator plate 48, thereby preventing rotation of the actuator plate even if the locking member 84 has been dislodged.

The safety locking bolt 96, of course could be actuated by gravity without a spring bias. A spring bias, however, is generally preferred inasmuch as the dual lock mechanism will then work regardless of the orientation of the safe, i.e., the safe can be upside down and the dual lock mechanism will effectively operate.

Figure 3:
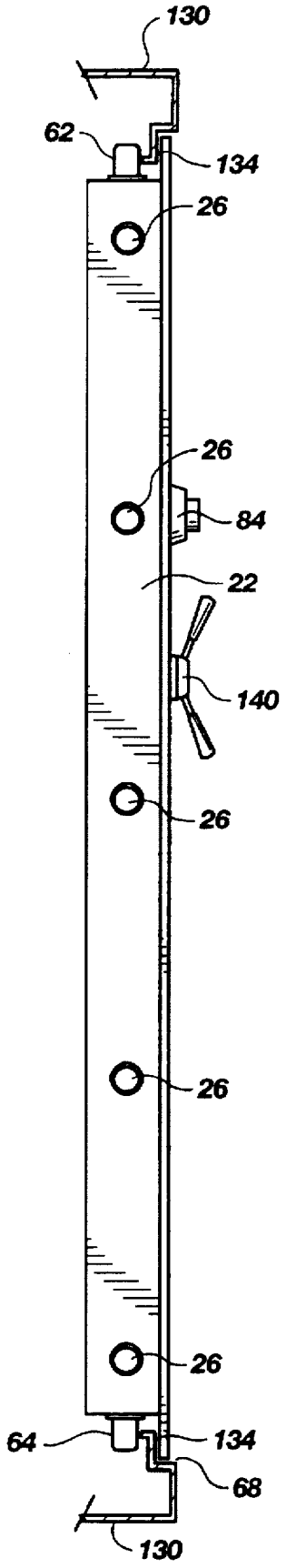
FIG. 3 shows a side view of the door shown in FIG. 1, so as to reveal the mechanisms for engaging and disengaging the door locking mechanism of the present invention, and a fragmented cross-sectional view of a safe body positioned about the door.

Referring now to FIG. 3, there is shown a side view of the door 10 and frame 22 discussed in FIG. 1, and a fragmented cross-sectional view of the safe body 130. The safe body 130 has a lip 134 which extends around an opening into which the door 10 fits. When locked, the locking bolts 26 and the locking pins 62 and 64 slide behind the lip 134 to prevent the door 10 from being opened.

When the locking member 84 is in an unlocked position, the locking bolts 26 and the locking pins 62 and 64 can be moved between first and second positions by rotating a handle 140 on a side of the door opposite the frame 22. When the handle 140 is rotated so that the rotating actuator plate 48 (FIGS. 1 and 2) rotates clockwise, the locking bolts 26 and locking pins 62 and 64, move behind the lip 134 to prevent opening of the door. When the handle 140 is rotated counter-clockwise, the locking bolts 26 and locking pins 62 and 64, retract through the frame 22 and allow the door to be opened.

Figures 4A, 4B:
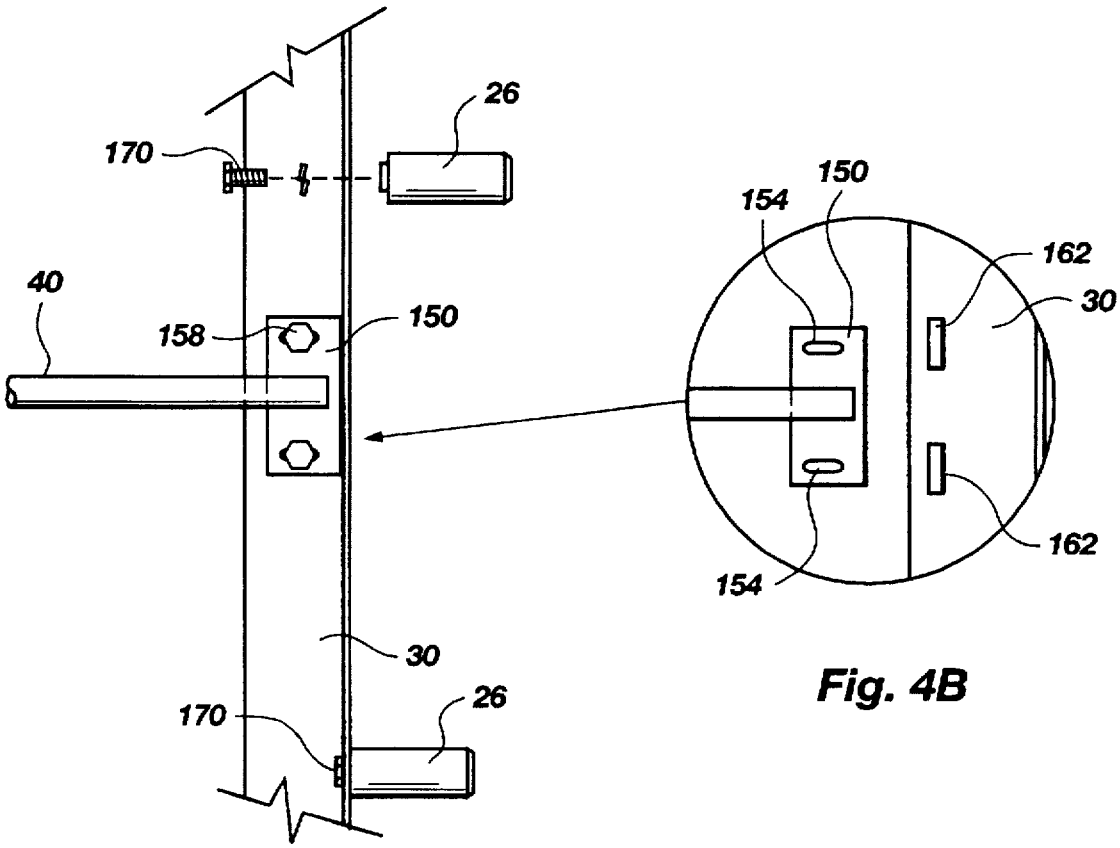
FIGS. 4A and 4B show fragmented close-up views of a portion of the locking mechanism including attachment mechanisms for connecting the actuator bars and the locking bolts.

Referring now to FIGS. 4A and 4B, there are shown close-up views of attachment mechanisms for connecting the locking bars 30 to the actuator bars 40 and to the locking bolts 26. The actuator bar 40 has a plate 150 extending transversely therefrom. The plate 150 has a pair of slots 154 formed therein for receiving a bolt 158. Likewise, the locking bar 30 has a pair of channels 162 which are generally transverse to the slots 154. When the slots 154 and the channels 162 are placed in an overlapping arrangement so that the bolts 158 may extend therethrough, an adjustable attachment mechanism is provided which enables horizontal and vertical adjustment of the position of the locking bar 30. This allows the actuator bar 40 to be attached to the locking bar 30 in situ without the need for welding. As will be appreciated by those skilled in the art, such an arrangement is less time consuming and enables the fine-tuning of the locking mechanism on the door before the bolts are tightened.

Additionally, the single actuator bar 40 connected by plate 150 to the locking bar 30 enables orientation between the locking bar and actuator bar to be adjusted vertically, horizontally and angularly, which is not the case with the prior art mechanisms in which the actuator bar equivalent is generally welded to the locking bar equivalent. Thus, if the holes in the frame (FIG. 1) are not formed in the proper position, the elongate bar 30 may be adjusted so that the locking bolts 26 better align with the holes.

Also shown in FIG. 4A are the locking bolts 26 which are attached to the locking bars 30 by bolts 170. As with the attachment mechanism for the actuator bars 40 and the locking bars 30, the bolts 170 enable fine adjustments in the position of the locking bolts 26, i.e. the distance which they extend through the frame, and thereby enable the locking mechanism to be fine-tuned on site. Of course, the locking bolts 26 could also be riveted to the locking bars 30.

Thus there is disclosed a door locking mechanism for safes. The mechanism provides a simple and effective way to prevent unauthorized entry into a safe, while minimizing the number of parts which may fail and prevent access to the contents of the safe. Additionally, the mechanism enables assembly and adjustment of some of the components of the locking mechanism on site, and without welding. Those skilled in the art will recognize numerous modifications which may be made while remaining within the scope and spirit of the invention. The appended claims are intended to cover such modifications.

What is claimed is:

1. A door locking mechanism for safes having a door with a perimeter and a frame disposed on an interior of the door adjacent the perimeter, and a locking member attached to the door, moveable between locked and unlocked positions, the locking mechanism comprising:

a rotatable actuator plate disposable adjacent a locking member such that movement of the locking member between locked and unlock positions selectively prevents and permits rotation of the actuator plate;

a plurality of actuation means connected in rotatable attachment to the rotatable actuator plate, at least one of the actuation means extending generally horizontally from the actuator plate and at least one extending generally vertically from the actuator plate, and such that rotation of the actuator plate causes horizontal movement of the horizontally extending actuation means and generally vertical movement of the generally vertically extending actuation means;

at least one locking bar and an adjustable attachment means for attaching the locking bar to the at least one horizontal actuation means so as to enable adjustment of horizontal and vertical orientations of the locking bar relative to the horizontal actuation means, the adjustment means comprising at least one slot, and the locking bar having a plurality of locking bolts disposed thereon so as to be extendable through the frame of a door such that movement of the horizontal actuation means causes simultaneous movement of the locking bolts in a similar direction; and wherein the rotatable actuator plate is disposed so as to simultaneously actuate each of the actuation means from a location adjacent the locking member.

2. The door locking mechanism of claim 1, wherein the generally vertical extending actuation means comprises at least one elongate locking pin extendable from the rotatable actuator plate through the frame of the door.

3. The door locking mechanism of claim 2, the door locking mechanism further comprising a door comprising a top side and a bottom side, wherein the locking mechanism is attached to the door, and wherein the generally vertical extending actuation means comprises an elongate locking pin extending generally upwardly to a location adjacent the top side of the door, and an elongate locking pin extending downwardly to a location adjacent the bottom side of the door.

4. The door locking mechanism of claim 3, wherein the elongate locking pins are attached to the rotatable actuator plate by a tab extending from the elongate locking pins.

5. The door locking mechanism of claim 1, wherein the plurality of locking bolts are adjustably attached to the locking bar so as to enable adjustment of a distance which said locking bolts extend from said locking bar.

6. The door locking mechanism of claim 1, wherein the actuation means comprises a plurality of actuator bars, and wherein each actuator bar is disposed at a predetermined vertical position, and wherein the actuator bars are attached to the rotatable actuator plate by slotted tabs so as to enable the actuator bars to maintain their predetermined vertical position as the actuator plate rotates.

7. The door locking mechanism of claim 1, wherein the locking member comprises a lock-actuated bolt, and wherein the rotatable actuator plate includes a channel formed therein for receiving the lock-actuated bolt, such that when the lock-actuated bolt is disposed within said channel, the rotatable actuator plate is unable to rotate.

8. The door locking mechanism of claim 7, further comprising a safety bolt and a notch formed in the rotatable actuator plate adjacent the safety bolt such that sufficient impact of the safety bolt causes said bolt to nest in said notch and prevent rotation of the actuator plate.

9. A door locking mechanism for securing a safe having an opening for receiving a door and a lip disposed about the opening, the mechanism comprising:

a door, having a perimeter with a top side, bottom side and lateral sides, a center section disposed roughly equidistant from each side, and a frame extending adjacent the perimeter and defining an enclosure; and a locking mechanism comprising:

a plurality of locking bolts slidably connected to the door and selectively engageable behind the lip of the enclosure so as to selectively prevent opening of the door, at least one locking bolt being disposable behind the lip along at least the top side and each lateral side;

adjustable actuation means in communication with the locking bolts for selectively moving the locking bolts, the actuation means comprising a horizontal actuation means for moving a plurality of locking bolts horizontally and at least one generally vertical extending actuation means for moving at least one bolt vertically and a plurality of elongate locking bars being attached to the plurality of locking bolts moved horizontally by the horizontal actuation means and having adjustable fastening means for connecting the horizontal actuation means to the locking bars so as to enable horizontal, vertical and angular adjustments in orientation between the locking bolts and the horizontal actuation means;

a single rotatable actuator plate connected to the actuation means and disposed adjacent a center section of the door, such that rotation of the rotatable actuator plate causes the actuation means to move, thereby moving the locking bolts.

10. The door locking mechanism of claim 9, wherein the generally vertical extending actuation means comprises at least one elongate locking pin extending from the rotatable actuator plate through the frame.

11. The door locking mechanism of claim 10, wherein the generally vertical extending actuation means comprises an elongate locking pin extending generally upwardly to a location adjacent the top side of the door, and an elongate locking pin extending downwardly to a location adjacent the bottom side of the door.

12. The door locking mechanism of claim 11, wherein the generally vertical extending actuation means comprises at least one locking bolt adjustably attachable to one of the locking pins, and a locking nut means for restricting adjustment of the locking bolt.

13. The door locking mechanism of claim 11, wherein the elongate locking pins are attached to the rotatable actuator plate by a tab extending from each elongate locking pin.

14. The door locking mechanism of claim 9, wherein the mechanism for securing a safe further comprises a locking member including a lock-actuated bolt, and wherein the rotatable actuator plate includes a channel formed therein for receiving the lock-actuated bolt, such that when the lock-actuated bolt is disposed within said channel, the rotatable actuator plate is unable to rotate.

15. The door locking mechanism of claim 9, wherein the horizontal actuation means comprises at least one horizontally extending actuation bar, and wherein the adjustable fastening means comprises an elongate locking bar adjustably attached to the actuation bar and attached to at least one locking bolt, such that horizontal movement of the actuation bar causes like horizontal movement of the locking bolt.

16. The door locking mechanism of claim 15, wherein a plurality of locking bolts are adjustably attached to the elongate locking bar.

17. The door locking mechanism of claim 15, wherein the elongate bar is attached to the actuation bar by an adjustable attachment means so as to enable either of the actuation bar and elongate locking bar to be replaced without replacing the other.

18. The door locking mechanism of claim 9, wherein the mechanism further comprises at least one locking bolt having a hole for receiving a threaded bolt and a crimpable shoulder member for holding the locking bolt to the threaded bolt.

19. The door locking mechanism of claim 15, wherein the elongate locking bar is attached to the actuation bar by a removable attachment means so as to enable either of the actuation bar and elongate locking bar to be replaced without replacing the other.

20. The door locking mechanism of claim 9, wherein the adjustable fastening means for connecting the horizontal actuation means to the locking bars comprises a plurality of slots formed in the horizontal actuation means and a plurality of channels formed in each of the locking bars, the plurality of slots and the plurality of channels being disposable in an overlapping configuration to enable horizontal, vertical and angular adjustment of the locking bars relative to the horizontal actuation means.

21. A door locking mechanism for safes having a door with a perimeter and a frame disposed on an interior of the door adjacent the perimeter, and a locking member attached to the door, moveable between locked and unlocked positions, the locking mechanism comprising:

a rotatable actuator plate disposable adjacent a locking member such that movement of the locking member between locked and unlock positions selectively prevents and permits rotation of the actuator plate;

a plurality of actuation means connected in rotatable attachment to the rotatable actuator plate, at least one of the actuation means extending generally horizontally from the actuator plate and at least one extending generally vertically from the actuator plate, and such that rotation of the actuator plate causes horizontal movement of the horizontally extending actuation means and generally vertical movement of the generally vertically extending actuation means;

at least one locking bar and an adjustable attachment means for attaching the locking bar to the at least one horizontal actuation means so as to enable adjustment of horizontal and vertical orientations of the locking bar relative to the horizontal actuation means, the locking bar having a plurality of locking bolts disposed thereon so as to be extendable through the frame of a door such that movement of the horizontal actuation means causes simultaneous movement of the locking bolts in a similar direction;

wherein the rotatable actuator plate is disposed so as to simultaneously actuate each of the actuation means from a location adjacent the locking member; and wherein the adjustable attachment means further comprises means for angularly adjusting the orientation of the at least one locking bar relative to the horizontal actuation means.

22. The door locking mechanism of claim 21, wherein the adjustable attachment means comprises a plurality of slots disposed in the at least one horizontal actuation means and a plurality of channels formed in the at least one locking bar, the plurality of slots and the plurality of channels being disposable in an overlapping configuration to enable horizontal, vertical and angular adjustment of the at least one locking bar relative to the at least one horizontal actuation means.

23. A door locking mechanism for safes having a door with a perimeter and a frame disposed on an interior of the door adjacent the perimeter, and a locking member attached to the door, moveable between locked and unlocked positions, the locking mechanism comprising:

a rotatable actuator means;

a plurality of actuation means attached to the rotatable actuator means, at least one of the actuation means extending generally horizontally from the actuator means such that rotation of the actuator means causes horizontal movement of the horizontally extending actuation means;

at least one locking bar; and an adjustable attachment means for attaching the locking bar to the at least one horizontal actuation means so as to enable adjustment of horizontal, vertical and angular orientations of the locking bar relative to the horizontal actuation means, the locking bar having a plurality of locking bolts disposed thereon so as to be extendable through the frame of a door such that movement of the horizontal actuation means causes simultaneous movement of the locking bolts in a similar direction.

24. The door locking mechanism of claim 23, wherein the adjustable attachment means comprises at least one slot.

25. The door locking mechanism of claim 23, wherein the adjustable attachment means comprises at least one channel.

26. The door locking mechanism of claim 23, wherein the adjustable attachment means comprises a plurality of slots and a plurality of channels, one of the pluralities being disposed horizontally and the other being disposed vertically.

27. A door locking mechanism for safes having a door with a perimeter and a frame disposed on an interior of the door adjacent the perimeter, and a locking member attached to the door, moveable between locked and unlocked positions, the locking mechanism comprising:

a rotatable actuator means;

a plurality of actuation means attached to the rotatable actuator means, at least one of the actuation means extending generally horizontally from the actuator means such that rotation of the actuator means causes horizontal movement of the horizontally extending actuation means;

at least one locking bar; and an adjustable attachment means for attaching the locking bar to the at least one horizontal actuation means so as to enable adjustment of horizontal and vertical orientations of the locking bar relative to the horizontal actuation means, the adjustable attachment means comprising at least one vertically disposed channel for connecting the locking bar to the horizontal actuation means to facilitate vertical adjustment of the locking bar.

* * * * *